US009488195B2

(12) United States Patent
Higuchi

(10) Patent No.: US 9,488,195 B2
(45) Date of Patent: Nov. 8, 2016

(54) HYDRAULIC SYSTEM FOR HYDRAULIC WORKING MACHINE

(75) Inventor: Takeshi Higuchi, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 386 days.

(21) Appl. No.: 14/004,262

(22) PCT Filed: Mar. 22, 2012

(86) PCT No.: PCT/JP2012/057329

§ 371 (c)(1),
(2), (4) Date: Sep. 10, 2013

(87) PCT Pub. No.: WO2012/133104

PCT Pub. Date: Oct. 4, 2012

(65) Prior Publication Data

US 2014/0033695 A1 Feb. 6, 2014

(30) Foreign Application Priority Data

Mar. 25, 2011 (JP) ..... 2011-067867

(51) Int. Cl.
*F15B 21/14* (2006.01)
*F15B 9/08* (2006.01)
*E02F 9/22* (2006.01)

(52) U.S. Cl.
CPC ..... *F15B 9/08* (2013.01); *E02F 9/2235* (2013.01); *E02F 9/2242* (2013.01); *E02F 9/2285* (2013.01); *E02F 9/2292* (2013.01);
(Continued)

(58) Field of Classification Search
CPC ..... F15B 21/14; F15B 2211/88
See application file for complete search history.

(56) References Cited

U.S. PATENT DOCUMENTS 6,922,989 B2 * 8/2005 Nagura ..... F15B 1/024 60/414
2003/0188530 A1 10/2003 Inoue et al.
(Continued)

FOREIGN PATENT DOCUMENTS

CN 1697933 A 11/2005
CN 101091065 A 12/2007
(Continued)

OTHER PUBLICATIONS

German Office Action dated Apr. 1, 2015 with English translation (nine pages).
(Continued)

*Primary Examiner* — F. Daniel Lopez
(74) *Attorney, Agent, or Firm* — Crowell & Moring LLP

(57) ABSTRACT

Disclosed is a hydraulic system for a hydraulic excavator. The hydraulic system inputs rotary power from a rotary power producing means to a hydraulic pump to produce hydraulic power, and operates an actuator by the hydraulic power. A hydraulic oil drain line from the actuator is branched into a flow rate control line as a line connected to a spool of a flow rate control valve controllable by manipulation of a lever and a power regeneration line as a line connected to a variable displacement motor for converting hydraulic power of discharged hydraulic oil to reusable energy. A regeneration ratio control means is also arranged to control the variable displacement motor such that a flow rate of the power regeneration line satisfies a preset fixed ratio α relative to a flow rate occurred in the flow rate control line by the manipulation of the lever.

2 Claims, 10 Drawing Sheets

(52) U.S. Cl.
CPC ..... *E02F9/2296* (2013.01); *F15B 21/14* (2013.01); *F15B 2211/20507* (2013.01); *F15B 2211/20546* (2013.01); *F15B 2211/6313* (2013.01); *F15B 2211/6316* (2013.01); *F15B 2211/6326* (2013.01); *F15B 2211/7058* (2013.01); *F15B 2211/7128* (2013.01); *F15B 2211/763* (2013.01); *F15B 2211/88* (2013.01)

(56) References Cited

U.S. PATENT DOCUMENTS

| | | | |
|---|---|---|---|
| 2004/0012103 | A1 | 1/2004 | Mulvaney et al. |
| 2004/0060430 | A1 | 4/2004 | Brinkman |
| 2006/0048508 | A1 | 3/2006 | Nakamura et al. |
| 2007/0169620 | A1 | 7/2007 | Kauss et al. |
| 2009/0288408 | A1 | 11/2009 | Tozawa et al. |
| 2011/0010047 | A1 | 1/2011 | Kawasaki et al. |

FOREIGN PATENT DOCUMENTS

| | | | |
|---|---|---|---|
| DE | 11 2009 000 6 | | 2/2011 |
| EP | 0 629 781 | A1 | 12/1994 |
| EP | 2 071 196 | A1 | 6/2009 |
| JP | 57-54704 | A | 4/1982 |
| JP | 11-117907 | A | 4/1999 |
| JP | 2002-31104 | A | 1/2002 |
| JP | 2002-349505 | A | 12/2002 |
| JP | 2004-511744 | A | 4/2004 |
| JP | 2004-138187 | A | 5/2004 |
| JP | 2006-511744 | A | 4/2006 |
| JP | 2006-312995 | A | 11/2006 |

OTHER PUBLICATIONS

Chinese Office Action dated Apr. 24, 2015 (six pages).
International Search Report dated Apr. 17, 2012 with English-language translation (five (5) pages).

* cited by examiner

FIG. 5A
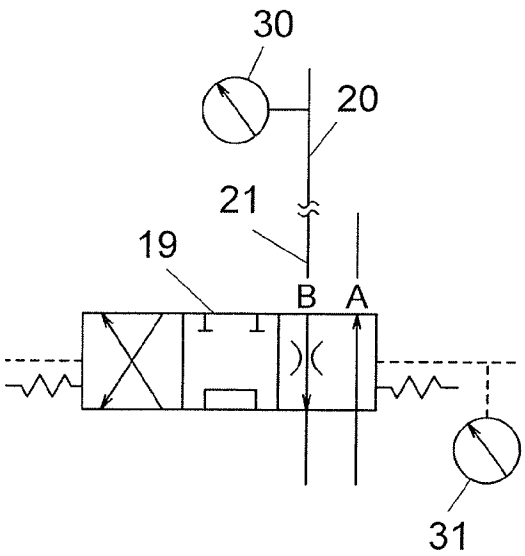
FIG. 5B
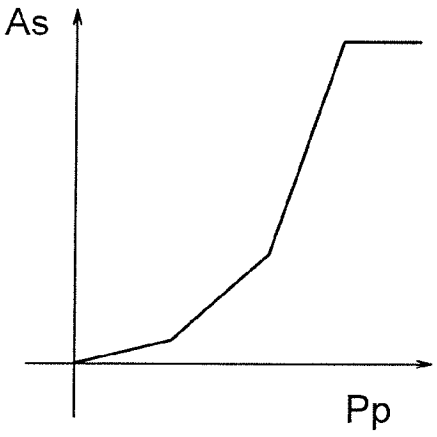
FIG. 5C
$$Q_1 = CAs\sqrt{\frac{2Pa}{\rho}} \cdots \text{(EQUATION 1)}$$
$C$: FLOW RATE COEFFICIENT, $\rho$: HYDRAULIC OIL DENSITY
$$Qt_2 = \alpha \cdot Q_1 \quad , \quad \alpha\text{: FLOW RATE RATIO}$$
$$q = \frac{Qt_2}{N} \cdots \text{(EQUATION 2)}$$
$q$: MOTOR DISPLACEMENT, $N$: NUMBER OF ROTATIONS

HYDRAULIC SYSTEM FOR HYDRAULIC WORKING MACHINE

TECHNICAL FIELD

This invention relates to a hydraulic system for a working machine such as a hydraulic excavator. The hydraulic system is equipped with a function to regenerate, as power, surplus energy in a hydraulic circuit.

BACKGROUND ART

Power regeneration technologies are used to improve the efficiency of hydraulic systems for hydraulic working machines. About such hydraulic systems for hydraulic working machines, a description will be made using, as an example, the hydraulic excavator disclosed in Patent Document 1.

In Patent Document 1, the hydraulic excavator has a configuration that two hydraulic pump motors driven by an electric motor are connected to two ports of a double-acting hydraulic cylinder, respectively. The double-acting hydraulic cylinder is of a single rod type, and the pressure-receiving area of its piston is different between an extension side and a retraction side. Therefore, the displacements of the two hydraulic pump motors are set at a ratio corresponding to the pressure-receiving areas of the piston. To control the speed and direction of the hydraulic cylinder, a controller performs, based on a manipulation stroke of a control lever, to control the rotation speed and rotation direction of the electric motor that drives the hydraulic pump motors. Further, in parallel to a line that connects a bottom side of the hydraulic cylinder and its corresponding hydraulic pump motor together, a line is arranged passing through a spool-type flow rate control valve controllable by the controller. The flow rate control valve is controlled to allow hydraulic oil, which has been discharged from the hydraulic cylinder, to pass through the flow rate control valve in a fine control range that the manipulation stroke of the control lever is smaller than a predetermined value, but is controlled to allow the hydraulic oil, which has been discharged from the hydraulic cylinder, to flow directly into the corresponding hydraulic pump motor without passing through the flow rate control valve when the manipulation stroke of the control lever exceeds the predetermined value. Owing to the configuration as described above, the flow rate control valve assures good speed control performance for the hydraulic cylinder in the fine control range, and the direct connection to the hydraulic pump motor assures good power regeneration efficiency when the manipulation stroke of the control lever exceeds the fine control range.

PRIOR ART DOCUMENT

Patent Document

Patent Document 1: JP-A-2002-349505

DISCLOSURE OF THE INVENTION

Problem to be Solved by the Invention

With the above-mentioned conventional technology disclosed in Patent Document 1, the speed of the hydraulic cylinder is control led relying solely upon rotation speed control of the hydraulic pump motor. The conventional technology is, therefore, accompanied by a problem in that, when the manipulation stroke of the control lever exceeds the fine control range, response is hardly assured to the manipulation of the lever although good regeneration efficiency can be assured.

With the above-mentioned actual situation of the conventional technology in view, the present invention has as an object thereof the provision of a hydraulic system for a hydraulic working machine, which can minimize effects of deteriorated response on the speed control of an actuator and can assure good controllability similar to that available from a spool-type flow rate control valve.

Means for Solving the Problem

To achieve this object, the present invention provides a hydraulic system for a hydraulic working machine, said hydraulic system being capable of inputting rotary power from a rotary power producing means to a hydraulic pump to produce hydraulic power and operating an actuator by the hydraulic power, wherein a hydraulic oil drain line from the actuator is branched into a flow rate control line as a line connected to a flow rate control spool controllable by manipulation of a lever and power regeneration line as a line connected to power regeneration means for converting hydraulic power of discharged hydraulic oil to reusable energy, and the hydraulic system is provided with a regeneration ratio control means for controlling the power regeneration means such that a flow rate of the power regeneration line satisfies a preset fixed ratio relative to a flow rate occurred in the flow rate control line by the manipulation of the lever.

According to the present invention configured as described above, by controlling the flow rate of the flow rate control line and that of the power regeneration line at a fixed ratio, a flow rate definitely occurs in the flow rate control line when the actuator is in operation. When the flow rate of the flow rate control line is changed by manipulating the lever and adjusting the spool-type flow rate control valve, the change in the flow rate, therefore, definitely affects the speed of the actuator so that the good response of the spool-type flow rate control valve is reflected. In addition, because the flow rate ratio of the power regeneration line to the flow rate control line is always constant, the amount of a change in the flow rate of the actuator always remains constant relative to the amount of a change in the flow rate of the flow rate control line by manipulation of the lever, the amount of a change in the speed of the actuator relative to a manipulation stroke of the lever remains constant, and good control performance can be obtained accordingly.

In the above-described invention, it may be preferred that the power regeneration means is a variable displacement motor, and that the regeneration ratio control means comprises a controller for calculating, from an operation pilot pressure produced by the manipulation of the lever, a pressure in the hydraulic oil drain line from the actuator and a rotation speed of the variable displacement motor, a target displacement for the variable displacement motor such that the flow rate of the power regeneration line satisfies the fixed ratio relative to the flow rate of the flow rate control line, and a motor displacement control means for controlling a displacement of the variable displacement motor by an electric command from the controller.

According to the present invention configured as described above, the flow rate of the flow rate control line is estimated from a pilot pressure occurred by manipulation of the lever and a pressure in the hydraulic oil drain line from the actuator, and using, as a target, a flow rate obtained by multiplying the flow rate with the predetermined ratio, the flow rate of the power regeneration line is subjected to feed forward control. It is, therefore, possible to further improve the response of the flow rate control of the power regeneration line.

In the above-described invention, it may also be preferred that the power regeneration means is a variable displacement motor, and that the regeneration ratio control means comprises a first pressure detection means arranged in the flow rate control line, a second pressure detection means arranged in the power regeneration line, and a motor displacement control means for decreasing a displacement of the variable displacement motor when a pressure of the first pressure detection means is higher than a pressure of the second pressure detection means, increasing the displacement of the variable displacement motor when the pressure of the first pressure detection means is lower than the pressure of the second pressure detection means, or fixing the displacement of the variable displacement motor when the pressure of the first pressure detection means and the pressure of the second pressure detection means are the same.

According to the present invention configured as described above, the flow rate control of the power regeneration line is performed by using only pressure information the detection of which is relatively easy, and therefore, a simple system configuration can be employed.

In the above-described invention, it may also be preferred that the first pressure detection means comprises a first pressure detection line branching from the flow rate control line, the second pressure detection means comprises a second pressure detection line branching from the power regeneration line, the motor displacement control means comprises a motor displacement control spool and a motor displacement control cylinder, and the first pressure detection line and the second pressure detection line are connected, in opposition to each other, to pressure-receiving parts having the same area and arranged at opposite ends of the motor displacement control spool, whereby the motor displacement control spool moves by a pressure relation between the first pressure detection line and the second pressure detection line, and by the movement of the motor displacement control spool, feed/discharge setting of hydraulic oil to/from the motor displacement control cylinder is switched to control the displacement of the variable displacement motor.

According to the present invention configured as described above, the flow rate control of the power regeneration line can be performed by hydraulic equipment alone. In a high radio noise environment, stable control can, therefore, be realized compared with the use of electronic control.

In the above-described invention, it may also be preferred that the power regeneration means is a variable displacement motor, and that the regeneration ratio control means comprises a first pressure detection means arranged in the flow rate control line, a second pressure detection means arranged in the power regeneration line, a third pressure detection means arranged in the hydraulic oil drain line, and a motor displacement control means for decreasing a displacement of the variable displacement motor when a value calculated by dividing a differential pressure, which has been obtained by subtracting a pressure of the second pressure detection means from a pressure of the third pressure detection means, with a differential pressure, which has been obtained by subtracting a pressure of the first pressure detection means from the pressure of the third pressure detection means, is greater than the preset fixed ratio, increasing the displacement of the variable displacement motor when the value calculated by dividing the differential pressure, which has been obtained by subtracting the pressure of the second pressure detection means from the pressure of the third pressure detection means, with the differential pressure, which has been obtained by subtracting the pressure of the first pressure detection means from the pressure of the third pressure detection means, is smaller than the preset fixed ratio, or fixing the displacement of the variable displacement motor when the value calculated by dividing the differential pressure, which has been obtained by subtracting the pressure of the second pressure detection means from the pressure of the third pressure detection means, with the differential pressure, which has been obtained by subtracting the pressure of the first pressure detection means from the pressure of the third pressure detection means, is the same as the preset fixed ratio.

According to the present invention configured as described above, the ratio of a flow rate of the flow rate control line and that in the power regeneration line can be set at a desired fixed ratio irrespective of the magnitude of line resistance between the branch point into the flow rate control line and power regeneration line and the branch point of the second pressure detection means, and therefore, the flexibility of the system configuration can be increased.

In the above-described invention, it may also be preferred that the first pressure detection means comprises a first pressure detection line branching from the flow rate control line, the second pressure detection means comprises a second pressure detection line branching from the power regeneration line, the third pressure detection means comprises a third pressure detection line branching from the hydraulic oil drain line, the motor displacement control means comprises a motor displacement control spool and a motor displacement control cylinder, pressure-receiving parts having a pressure-receiving area A and pressure-receiving parts having a pressure-receiving area B are arranged in pairs at opposite ends of the motor displacement control spool, respectively, such that in each of the pairs, the pressure-receiving parts are opposite to each other, the first pressure detection line and third pressure detection line are connected to the opposing pressure-receiving parts having the area A, the second pressure detection line and third pressure detection line are connected to the opposing pressure-receiving parts having the area B, and a portion of the third pressure detection line, said portion being connected to the area A, is connected to be located on an side opposite to a portion of the third pressure detection line, said latter portion being connected to the area B, whereby the motor displacement control spool moves by a magnitude relation between a differential pressure between the first pressure detection line and the third pressure detection line and a differential pressure between the second pressure detection line and the third pressure detection line, and by the movement of the motor displacement control spool, feed/discharge setting of hydraulic oil to/from the motor displacement control cylinder is switched to control the displacement of the variable displacement motor.

According to the present invention configured as described above, the ratio of a flow rate of the flow rate control line and that of the power regeneration line can be set at a desired fixed ratio by hydraulic equipment alone irrespective of the magnitude of line resistance between the branch point into the flow rate control line and power regeneration line and the branch point of the second pressure detection means. In a high radio noise environment, stable control can, therefore, be realized compared with the use of electronic control.

In the above-described invention, it may also be preferred that the power regeneration means is mechanically connected to the hydraulic pump.

According to the present invention configured as described above, the hydraulic power recovered by the power regeneration means can be regenerated as it is by the hydraulic pump. Compared with performing regeneration via another type of power such as electric power, it is, therefore, possible to minimize power loss and to achieve still higher energy regeneration efficiency.

Advantageous Effects of the Invention

In the present invention, by controlling the flow rate of the flow rate control line and that of the power regeneration line at the fixed ratio, a flow rate definitely occurs in the flow rate control line when the actuator is in operation. When the flow rate of the flow rate control line is changed by manipulating the lever and adjusting the flow rate control valve, the change in the flow rate definitely affects the speed of the actuator so that according to the present invention, the good response of a spool-type flow rate control valve can be reflected. In addition, because the flow rate ratio of the power regeneration line to the flow rate control line is always constant, the amount of a change in the flow rate of the actuator always remains constant relative to the amount of a change in the flow rate of the flow rate control line by manipulation of the lever, and the amount of a change in the speed of the actuator relative to a manipulation stroke of the lever remains constant. The present invention can, therefore, obtain good control performance. In other words, the present invention can minimize effects of deteriorated response to the speed control of the actuator, can assure good controllability similar to that available from a spool-type flow rate control valve, and can obtain working performance of higher accuracy than before.

BRIEF DESCRIPTION OF THE DRAWINGS

FIGS. 3A and 3B are flow charts for the supplementary description of operation of the first embodiment, in which FIG. 3A is a flow chart illustrating main processing and FIG. 3B is a flow chart illustrating processing A included in the main processing.

FIGS. 5A to 5C are diagrams for the supplementary description of operation of the second embodiment, in which FIG. 5A is a diagram showing a flow rate control valve and its associated elements on an enlarged scale, FIG. 5B is an opening area diagram of a spool of the flow rate control valve, said opening area diagram being contained in the controller, and FIG. 5C is a diagram illustrating equations for use in the description.

MODES FOR CARRYING OUT THE INVENTION

Embodiments of the hydraulic system according to the present invention for the working machine will hereinafter be described with reference to the drawings.

Figure 1:
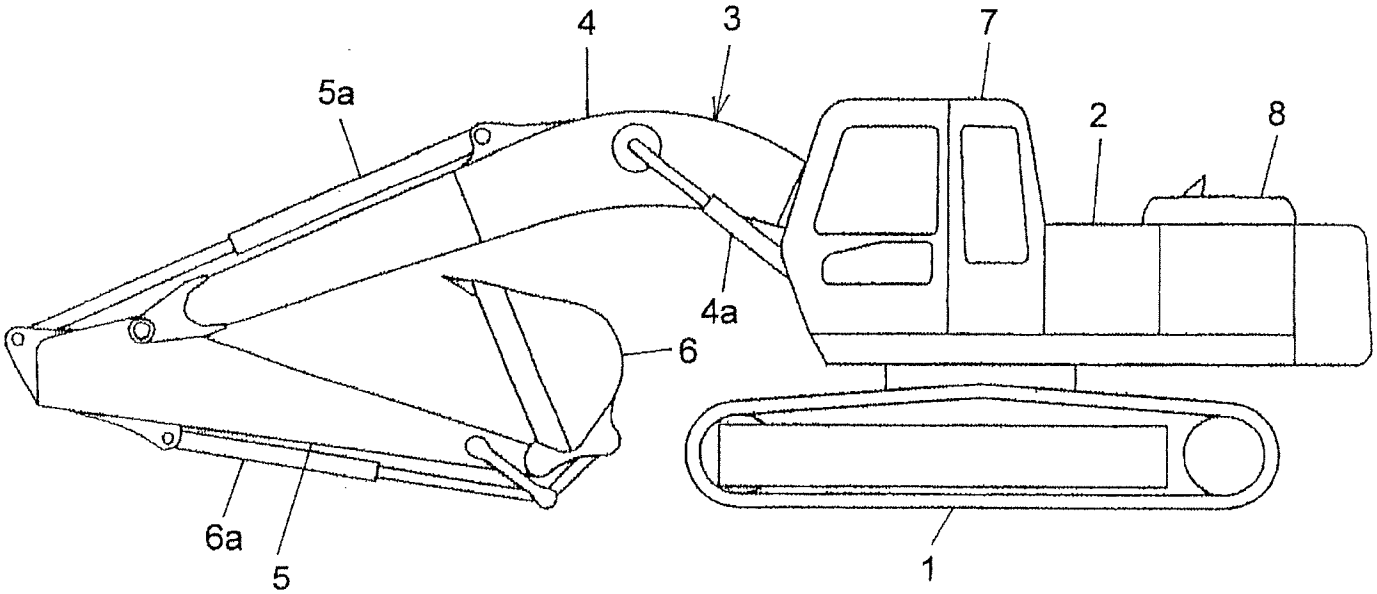
FIG. 1 is a side view showing a hydraulic excavator exemplified as an example of a hydraulic working machine on which a hydraulic system according to the present invention can be arranged.

FIG. 1 is a side view showing a hydraulic excavator exemplified as an example of the hydraulic working machine on which the hydraulic system according to the present invention can be arranged.

As shown in FIG. 1, the hydraulic excavator is provided with a travel base 1, an upperstructure 2 mounted on the travel base 1, and working equipment 3 pivotally attached to the upperstructure 2. The working equipment 3 includes a boom 4 connected pivotally in an up-and-down direction to the upperstructure 2, an arm 5 connected pivotally in the up-and-down direction to a free end of the boom 4, and a bucket 6 connected pivotally in the up-and-down direction to a free end of the arm 5. This working equipment 3 also includes a boom cylinder 4*a* for actuating the boom 4, an arm cylinder 5*a* for actuating the arm 5, and a bucket cylinder 6*a* for actuating the bucket 6. An operator's cab 7 is arranged on the upperstructure 2, and an engine compartment 8 with hydraulic pumps and the like accommodated therein is arranged rearward of the operator's cab 7.

Figure 2:
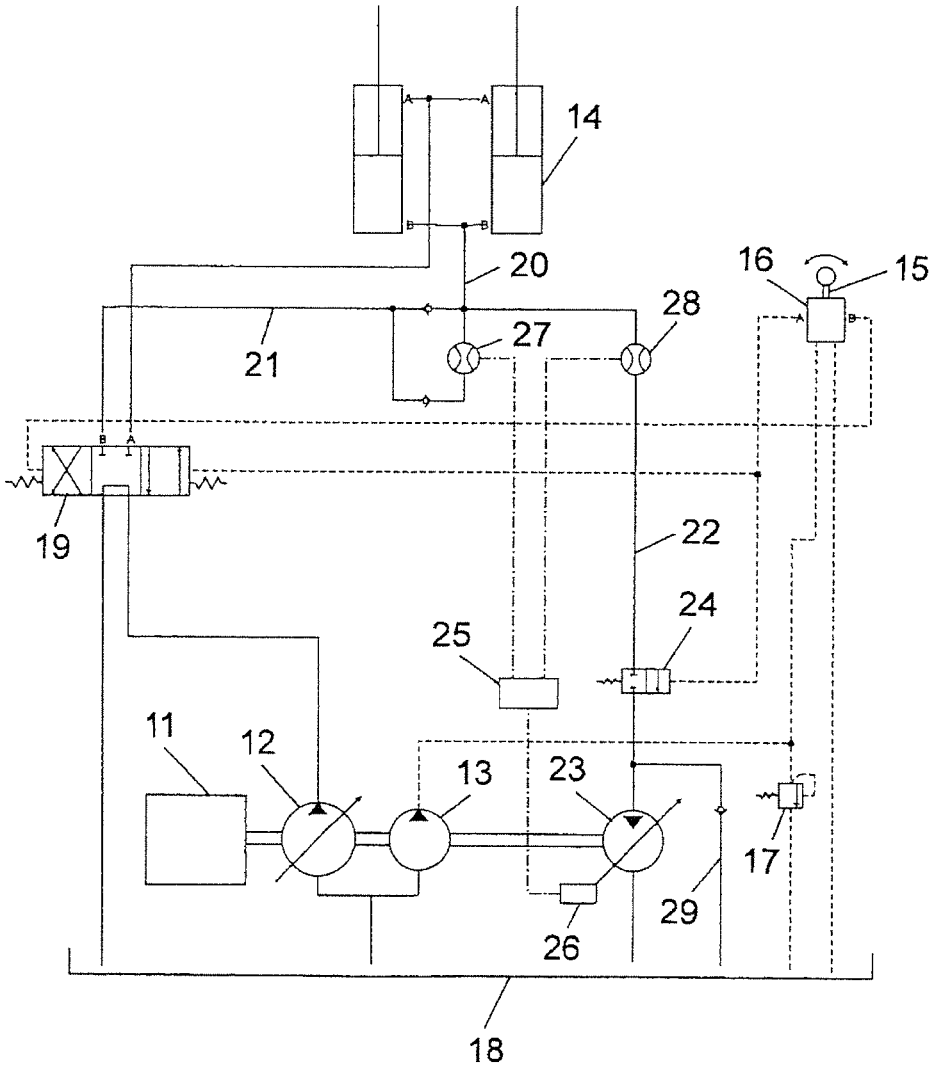
FIG. 2 is a hydraulic circuit diagram illustrating a first embodiment of the hydraulic system according to the present invention as arranged on the hydraulic excavator shown in FIG. 1.

FIG. 2 is a hydraulic circuit diagram illustrating a first embodiment of the hydraulic system according to the present invention as arranged on the hydraulic excavator shown in FIG. 1.

A rotary power producing means 11 illustrated in this FIG. 2 is a device for converting electric energy or energy of a fossil fuel to rotary power, such as an electric motor or engine, an output shaft of the rotary power producing means 11 is mechanically connected to an input shaft of a hydraulic pump 12 and that of a pilot pump 13, and the hydraulic pump 12 and pilot pump 13 are driven by the rotary power producing means 11. It is to be noted that the rotary power producing means 11 performs control to maintain the rotation speed of its output shaft substantially constant.

The hydraulic pump 12 is a device for producing hydraulic power that drives an actuator 14 to be described subsequently herein, and is configured to permit adjusting the flow rate of hydraulic oil to be delivered per rotation. The delivery flow rate of the hydraulic oil can, therefore, be changed even when the number of rotations of the input shaft is constant. The displacement of the hydraulic pump 12 is controlled by an unillustrated regulator based on a manipulation stroke of a lever 15 to be described subsequently herein (a pilot pressure produced at a pilot valve 16 to be described subsequently herein), the delivery pressure of the hydraulic pump 12, a load margin of the rotary power producing means 11, and the like.

The pilot pump 13 is a device for producing a pilot pressure to be used for the control of hydraulic equipment to be described subsequently herein, and the flow rate of hydraulic oil to be delivered per rotation is fixed. The hydraulic oil delivered by the pilot pump 13 is allowed to return to a hydraulic oil tank 18 via a pilot relief valve 17, and the pressure of a pilot circuit is maintained at the setting pressure of the pilot relief valve 17.

The actuator 14 is, for example, the above-mentioned boom cylinder 4*a*, that is, a double-acting single rod hydraulic cylinder, and is connected to the hydraulic pump 12 as power source via a flow rate control valve 19. The flow rate control valve 19 is a three-position, four-port hydraulic pilot selector valve, and is operated by a pilot pressure adjusted at the pilot valve 16. When the pilot valve 16 is operated to a side A by the lever 15, a high pressure arises on a right side of the flow rate control valve 19 as viewed in the diagram so that a spool of the flow rate control valve 19 moves leftward. Then, the hydraulic pump 12 and a port A of the actuator 14 are connected together, the actuator 14 retracts, and the hydraulic oil discharged from a port B of the actuator 14 flows through a hydraulic oil drain line 20 and branches into a flow rate control line 21 and power regeneration line 22. The hydraulic oil in the flow rate control line 21 passes through the flow rate control valve 19 and returns to the hydraulic oil tank 18, and the hydraulic oil in the power regeneration line 22 passes through power regeneration means to be described subsequently herein, for example, a variable displacement motor 23 and returns to the hydraulic oil tank 18. It is to be noted that, when the actuator 14 is retracting (when the pilot valve 16 has been operated to the side A), a selector valve 24 arranged in the power regeneration line 22 is in an open position and a portion of the hydraulic oil discharged from the port B of the actuator 14 is hence allowed to pass through the variable displacement motor 23. When the pilot valve 16 is conversely operated to a side B, a high pressure arises on a left side of the flow rate control valve 19 as viewed in FIG. 2 so that the spool of the flow rate control valve 19 moves rightward. Then, the hydraulic pump 12 and the port B of the actuator 14 are connected together, the actuator 14 extends, and the hydraulic oil discharged from the port A of the actuator 14 flows through the flow rate control valve 19 and returns to the hydraulic oil tank 18. It is to be noted that, when the actuator 14 is extending (when the pilot valve 16 has been operated to the side B), the selector valve 24 arranged in the power regeneration line 22 is in a closed position and the hydraulic oil fed from the hydraulic pump 12 is fed in its entirety to the actuator 14 without flowing into the variable displacement motor 23.

The variable displacement motor 23 is mechanically connected at an output shaft thereof to the hydraulic pump 12 (like the rotary power producing means 11 and pilot pump 13). As the variable displacement motor 23 can change the flow rate of hydraulic oil per rotation, the suction flow rate can be changed even when the number of rations of the output shaft is constant. The displacement of the variable displacement motor 23 is adjusted by a motor displacement control means operable upon receipt of a target displacement command from a controller 25 to be described subsequently herein, for example, by an electronically-controlled regulator 26. It is to be noted that the variable displacement motor 23 is also always rotating because the variable displacement motor 23 and the hydraulic pump 12 are mechanically connected together. When hydraulic oil is flowing into an input port of the variable displacement motor 23, the variable displacement motor 23 acts as a motor to generate a drive torque for the hydraulic pump 12, and assists the rotary power producing means 11. Without inflow of sufficient hydraulic oil, on the other hand, the variable displacement motor 23 sucks up hydraulic oil from a make-up line 29 and acts as a pump so that a torque is absorbed (lost) conversely. In this first embodiment, the variable displacement motor 23 is comprised of a variable displacement motor the minimum displacement of which is zero (neither suction nor delivery of hydraulic oil is performed even when the motor rotates) in order to limit the loss to the minimum in the above-mentioned situation.

The regeneration ratio control means, which is arranged in this first embodiment to control the power regeneration means, specifically the variable displacement motor 23 such that a flow rate of the power regeneration line 22 satisfies a preset fixed ratio relative to a flow rate occurred in the flow rate control line 21 by manipulation of the lever 15 arranged in this first embodiment, is constructed of flowmeters 27,28 arranged in the flow rate control line 21 and power regeneration line 22, respectively, the controller 25, and the electronically-controlled regulator 26. By the flowmeters 27,28, the flow rates of hydraulic oil passing through the respective lines of the flow rate control line 21 and power regeneration line 22 can be detected as electric signals. Concerning the flowmeter 27, it is to be noted that only the flow discharged from the actuator 14 is allowed to pass by the flowmeter 27 because the flow of hydraulic oil through the flow rate control line 21 is bidirectional. Further, outputs of the flowmeters 27,28 are connected to the controller 25.

At the controller 25, the electric signal from the flowmeter 27 is converted to a flow rate Q1 of the flow rate control line 21, which is multiplied with a preset flow rate ratio $\alpha$ of the power regeneration line 22 to the flow rate control line 21 to calculate a target flow rate Qt2 ($=\alpha Q1$) for the power regeneration line 12. The thus-calculated target flow rate Qt2 for the power regeneration line 22 and an actual flow rate Q2 of the power regeneration line 22 as obtained by converting the electric signal from the flowmeter 28 are compared with each other, and a command is delivered to the electronically-controlled regulator 26 such that the displacement of the variable displacement motor 23 is decreased when $Q2>Qt2+\beta$, the displacement is increased when $Q2<Qt2-\beta$, or the displacement at that time point is maintained when $Qt2-\beta \leq Q2 \leq Qt2+\beta$. Further, control to forcedly set at the minimum displacement when $Q1<\gamma$ is also included. Here, $\beta$ means a dead band for stabilizing the control, and $\gamma$ means a minimum flow rate of Q1 that enables power regeneration. The value of $\beta$ is set at several percent or so of the maximum flow rate of Q2, and the value of $\gamma$ is set at several percent or so of the maximum flow rate of Q1. The values of $\beta$ and $\gamma$ are each determined by postulating a range capable of sufficiently preventing any false operation for measurement errors by an arranged flowmeter.

The configuration and operation of the first embodiment are summarized as mentioned above. A supplementary description will be made about transitional states in a series of operations upon causing the actuator 14 to retract (upon performing power regeneration).

First, in a state that the lever 15 has not been manipulated, the pilot pressure that acts from the pilot valve 16 on the flow rate control valve 19 and also on the selector valve 24 in the power regeneration line 22 is the tank pressure (substantially zero). In this state, the flow rate control valve 19 is in the center position under the forces of springs arranged at opposite ends of its spool, and the actuator 14 is stationary. Therefore, the flow rate Q1 detected by the flowmeter 27 is zero. On the other hand, the selector valve 24 is in the position where it closes the line under spring force, and therefore, the flow rate Q2 detected by the flowmeter 28 is also zero. At this time, the determination of $Q1<\gamma$ is made at the controller 25, a command that sets the target displacement for the variable displacement motor 23 at the minimum displacement is delivered to the electronically-controlled regulator 26, and the displacement of the variable displacement motor 23 is set at zero.

As illustrated in step S1 of FIG. 2A, a value of a that corresponds to a mode (response preference or power regeneration efficiency preference) is next set in the controller 25. When the pilot valve 16 is operated to the side A from the position where the lever 15 has not been manipulated as illustrated in step S2, the spool of the flow rate control valve 19 begins to move leftward shortly after the operation, so that the line, which connects the hydraulic pump 12 and the port A of the actuator 14 together, and the line, which connects the hydraulic oil tank 18 and the port B of the actuator 14 together, begin to open. Further, the pilot pressure also acts on the selector valve 24 in the power regeneration line 22, so that its spring is pressed and the line begins to open. At this time, a flow rate begins to gradually occur in the flow rate control line 21, and processing A in step S3 is started. According to this processing A, at the controller 25, the flow rates Q1, Q2 are computed corresponding to electric signals from the flowmeters 27,28 as illustrated in step S11 of FIG. 2B, and further, $Qt2=Q1$ is computed as illustrated in step S12. In a state that Q1 has been found to have a value in the range of $0<Q1<\gamma$ by the determination in step S13, the variable displacement motor 23 is still in the controlled state of zero displacement, and Q2 remains to be 0 ($Q2=0$). When time goes on and at a time point that Q1 has become equal to or greater than $\gamma$ ($Q1\geq\gamma$), Q2 is still 0 ($Q2=0$). The determination in step S14 results in YES ($Q2<Qt2-\beta$), and in the controller 25, the value of the target displacement for the variable displacement motor 23 begins to increase. When time goes on further, the value of the target displacement command from the controller 25 to the electronically-controlled regulator 26 also increases adequately, and Q2 corresponding to the displacement of the variable displacement motor 23 is generated. When this state continues, the determination in step S15 eventually results in YES ($Qt2-\beta\leq Q2\leq Qt2+\beta$) and the displacement of the variable displacement motor 23 at that time is retained. In this manner, the flow rate Q2 of the power regeneration line 22 is adjusted to satisfy the preset fixed ratio ($Q2\approx Qt2=\alpha Q1$) relative to the flow rate Q1 of the flow rate control line 21.

Figure 3A:
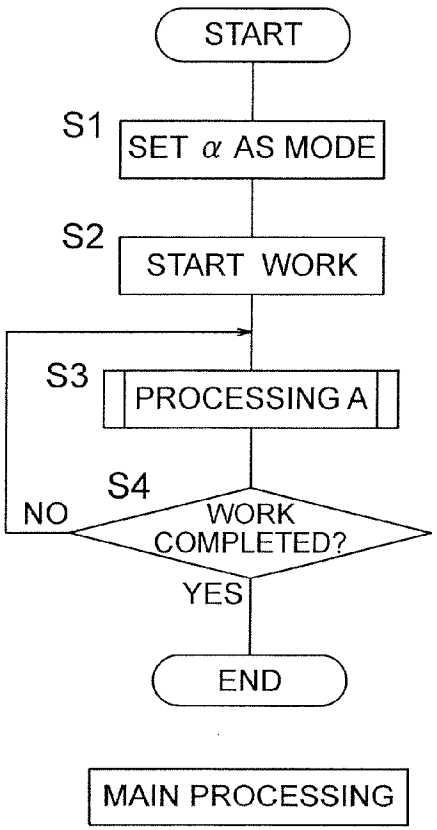
Figure 3B:
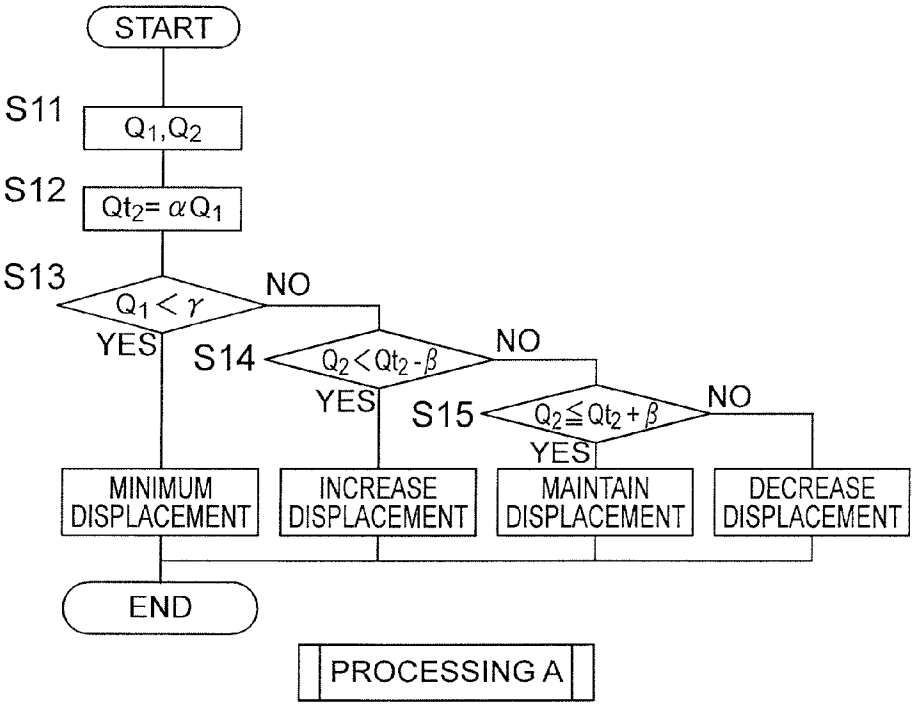

A description will next be made about a case of returning the lever 15 from the state that the pilot valve 16 has been operated to the side A and the flow rate Q2 of the power regeneration line 22 has been adjusted to satisfy the preset fixed ratio. When it begins to return the lever 15, the spool of the flow rate control valve 19 begins to move rightward, and the line, which connects the hydraulic pump 12 and the port A of the actuator 14 together, and the line, which connects the hydraulic oil tank 18 and the port B of the actuator 14 together, begin to close. At this time, the flow rate Q1 of the flow rate control line 21 begins to decrease gradually. When time goes on and the determination in step S15 of FIG. 3B results in the state of NO, that is, the state of $Q2>Qt2+\beta$, the value of the target displacement for the variable displacement motor 23 begins to decrease in the controller 25. The displacement of the variable displacement motor 23 then decreases correspondingly, and the flow rate Q2 of the power regeneration line 22 is readjusted to satisfy the preset fixed ratio ($Q2\approx Qt2=\alpha Q1$). As illustrated in FIG. 3A, the control of the variable displacement motor 23 ends upon completion of the work.

Incidentally, the flow rate Q2 of the power regeneration line 22 progressively decreases with the preset fixed ratio ($Q2\approx Qt2=\alpha Q1$) being maintained when the manipulation to return the lever 15 is slowly conducted, but a situation arises that the readjustment of a decrease in the flow rate of the power regeneration line 22 does not catch up a decrease in the flow rate of the flow rate control line 21 when the lever 15 is quickly returned. When the lever 15 is returned to a neutral (unmanipulated) state in such a situation, the selector valve 24 in the power regeneration line 22 also moves to a position where it closes the line, so that the flow of hydraulic oil through the power regeneration line 22 is forcedly cut off. As the variable displacement motor 23 has at this moment a certain displacement which is not zero, the variable displacement motor 23 sucks up hydraulic oil from the make-up line 29 illustrated in FIG. 1, thereby avoiding cavitation which would otherwise occur due to an insufficient feed flow rate to the suction port, reducing an increase in absorbed torque (power loss) as a result of pumping action of the variable displacement motor 23, and also minimizing damage to the variable displacement motor 23. Further, $Q1=Q2=0$ is satisfied by the closure of both the flow rate control valve 19 and the selector valve 24, $Q1<\gamma$ is determined at the controller, a command that sets the target displacement for the variable displacement motor 23 at the minimum displacement is delivered to the electronically-controlled regulator 26, and the displacement of the variable displacement motor 23 finally returns to zero. Because a quick lever-returning manipulation, when conducted, can quickly stop the actuator 14 irrespective of the displacement condition of the variable displacement motor 23 as described above, it is possible to avoid a danger which would otherwise arise due to a delay in the stoppage of the actuator 14 in the event of an emergency.

As there is always a flow rate occurred through the flow rate control valve 19 upon operation of the actuator 14 in the above-mentioned first embodiment, flow rate adjusting action that occurs responsive to a change in the manipulation stroke of the lever at the flow rate control valve 19 is necessarily reflected to the operation speed of the actuator 14. Needless to say, the flow rate control by the variable displacement motor 23, which is inferior in response compared with the flow rate control valve 19, is included, so that the response to a lever manipulation in this embodiment is inferior when compared with that available from a conventional common hydraulic system for a hydraulic working machine that a flow rate fed to or discharged from the actuator 14 is allowed to flow in its entirety to the flow rate control valve 19. Nonetheless, practical utility can be assured by setting the flow rate ratio of the power regeneration line 22 to the flow rate control line 21 such that incommensurate with the response of the variable displacement motor 23 in flow rate control, the deficiency in response can be suppressed to a problem-free level. Further, the flow rate ratio of the power regeneration line 22 to the flow rate control line 21 is determined by the constant $\alpha$ set in the controller 25, so that the hydraulic excavator can be operated by switching the response to a mode with great importance placed on the response or a mode with great importance placed on the power regeneration efficiency if a mode switching means or the like is arranged to permit switching the constant $\alpha$ from the outside.

Figure 4:
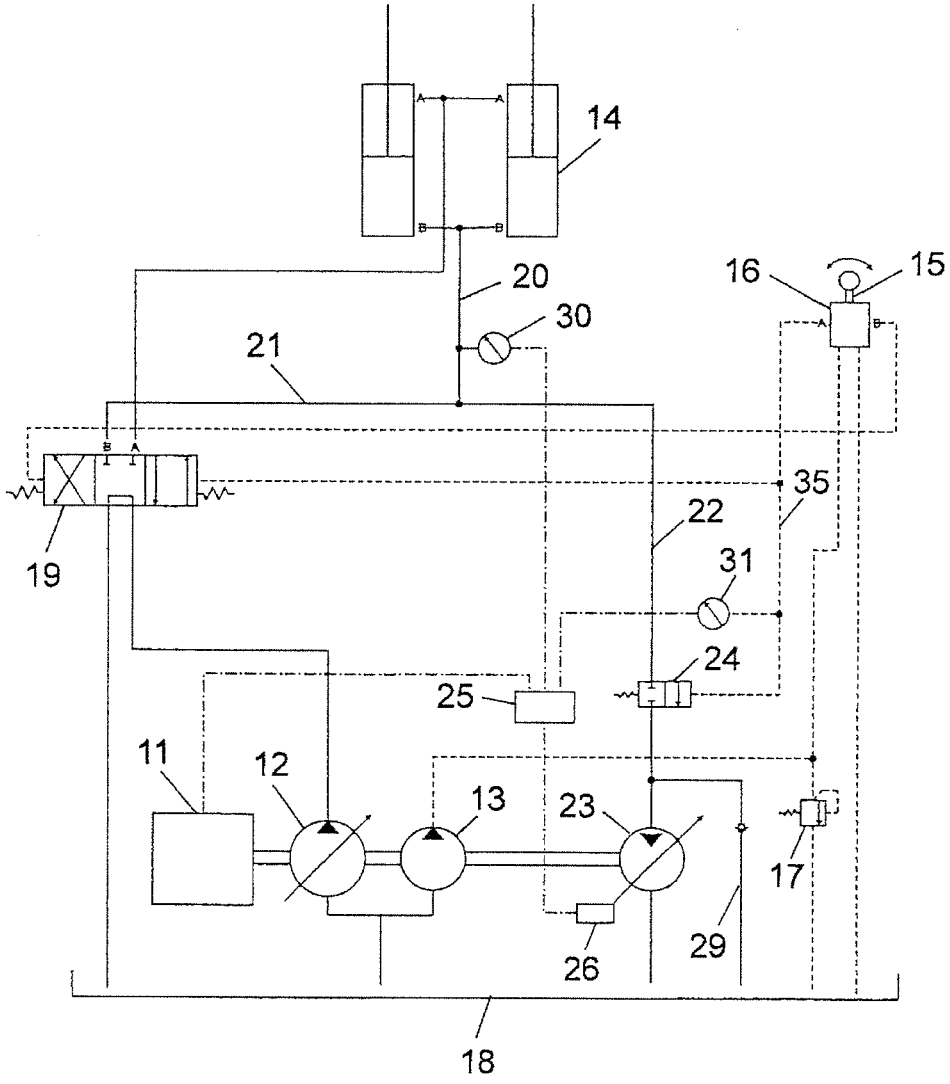
FIG. 4 is a hydraulic circuit diagram illustrating a second embodiment of the present invention.

With reference to FIGS. 4 and 5, a description will next be made about a second embodiment of the present invention. It is to be noted that a description on parts common to the first embodiment is omitted and a description will be made solely of the part of a regeneration ratio control means different from the first embodiment.

The regeneration ratio control means in this second embodiment is constructed, as illustrated in FIG. 4, of a pressure meter 30 arranged in the hydraulic oil drain line 20, a pressure meter 31 arranged in a pilot line 35 in which a pressure rises upon performing operation to retract the actuator 14 (upon operation of the pilot valve 16 to the side A), the controller 25, and the electronically-controlled regulator 26. The pressure meters 30,31 serve to detect respective pressures of the hydraulic oil drain line 20 and pilot line 35 as electric signals, and outputs of the pressure meters 30,31 are fed to the controller 25 and are converted to actuator discharge pressure Pa and pilot pressure Pp, respectively. In addition to the electric signals from the pressure meters 30,31, an electric signal which is synchronous with the rotation of the rotary power producing means 11 is also inputted to the controller 25, and in the controller 25, the number of rotations per unit time of the rotary power producing means 11 is calculated from the electric signal. In the case of this second embodiment, the rotary power producing means 11 and the power regeneration means, that is, the variable displacement motor 23 are the same in rotation speed. Further, stored in the controller 25 is an opening area diagram of the spool of the flow rate control valve 19, through which at the time of retraction of the actuator 14, the hydraulic oil discharged from the port B of the actuator 14 passes upon returning to the hydraulic oil tank 18.

When the pilot pressure Pp is lower than δ (Pp≤δ), the controller 25 outputs, to the variable displacement motor 23, a command that minimizes the displacement of the variable displacement motor 23. δ is set at several percent or so of a maximum value of the pilot pressure Pp, and is a threshold value for preventing outputting an unnecessary control command to the variable displacement motor 23 by a slight variation in the pilot pressure Pp itself or an electric noise produced in the pressure meter when the pilot valve 16 has not been operated to the side A, in other words, when the actuator 14 is not retracting. At this time, the selector valve 24 arranged in the power regeneration line 22 is in the position where it cuts off the line under spring force, and no flow rate occurs in the power regeneration line 22.

When the pilot valve 16 is operated to the side A and the pilot pressure Pp rises to or higher than δ (δ≤Pp), the computation of the target displacement for the variable displacement motor 23 is performed at the controller 25. First, as shown in the opening area diagram of FIG. 5B on the spool of the flow rate control valve 19 shown in FIG. 5A versus the pilot pressures recorded in the controller 25, an opening area As of the spool of the flow rate control valve 19, which corresponds to the current pilot pressure Pp, is obtained. From the discharge pressure Pa of the actuator 14 and the spool opening area As, the flow rate Q1 of the flow rate control line 21 is estimated using Equation (1) in FIG. 5C. By multiplying the estimated Q1 with the preset fixed ratio α, the target flow rate Qt2 for the power regeneration line 23 is then determined. From the target flow rate Qt2 for the power regeneration line 22 and the number of rotations per unit time of the variable displacement motor 23, a target displacement q for the variable displacement motor 22 (delivery/suction flow rate per rotation of the motor) is calculated using Equation (2) shown in FIG. 5C. The controller 25 outputs, to the electronically-controlled regulator 26, a command corresponding to the thus-determined target displacement q for the variable displacement motor 23. When the pilot pressure is in the state of δ≤Pp, this displacement control of the variable displacement motor 23 is always performed.

When the pilot valve 16 is operated to the side B, the variable displacement motor 23 is always controlled at the minimum displacement because the pilot pressure Pp is lower than δ (Pp<δ). Further, the selector valve 24 is also in the position where it cuts off the line. Therefore, no flow rate occurs in the power regeneration line 22, the hydraulic oil delivered from the hydraulic pump 12 flows in its entirety into the port B of the actuator 14, and the hydraulic oil discharged from the port A of the actuator 14, in its entirety, passes through the flow rate control valve 19 and returns to the hydraulic oil tank 18.

In the second embodiment configured as described above, the control of the variable displacement motor 23 is subjected to feed forward control (predictive control) by the lever manipulation stroke (pilot pressure Pp). Therefore, a control delay of the variable displacement motor 23 is hard to occur, and the second embodiment is excellent in response to lever manipulation.

Figure 6:
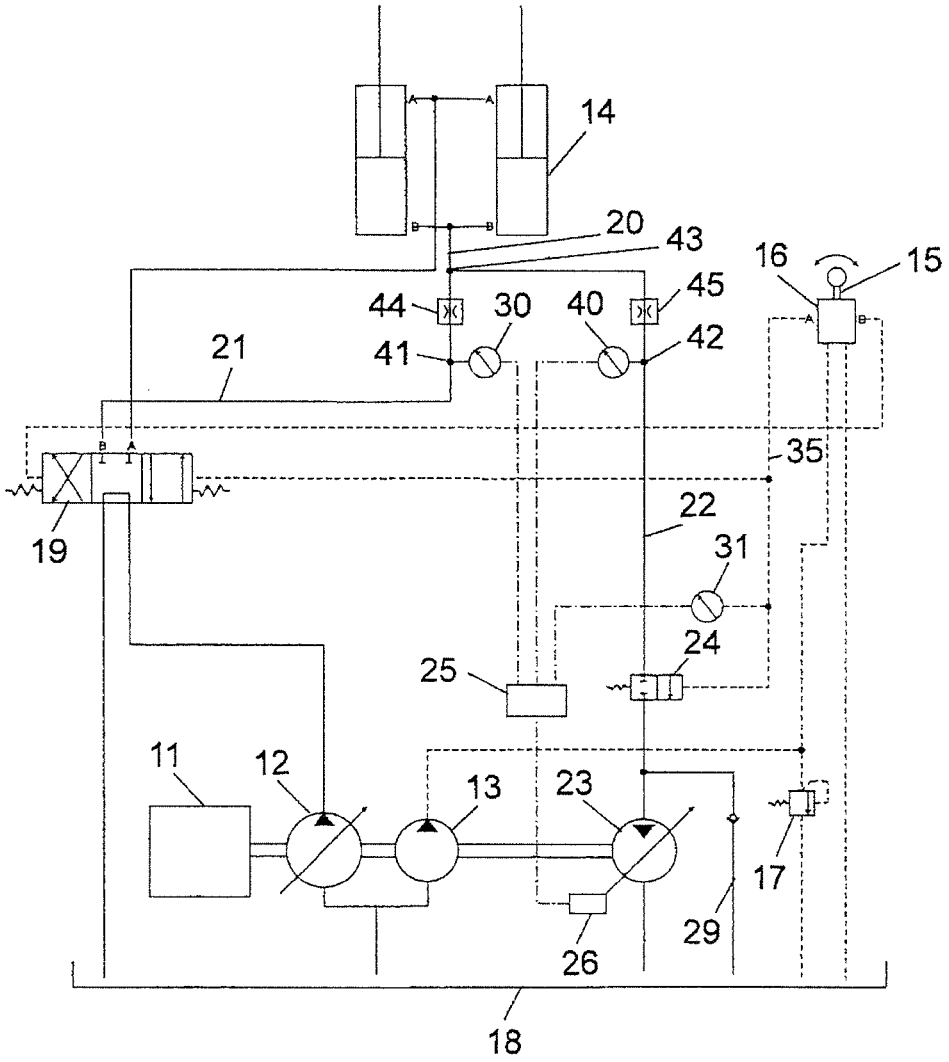
FIG. 6 is a hydraulic circuit diagram illustrating a third embodiment of the present invention.
Figure 7:
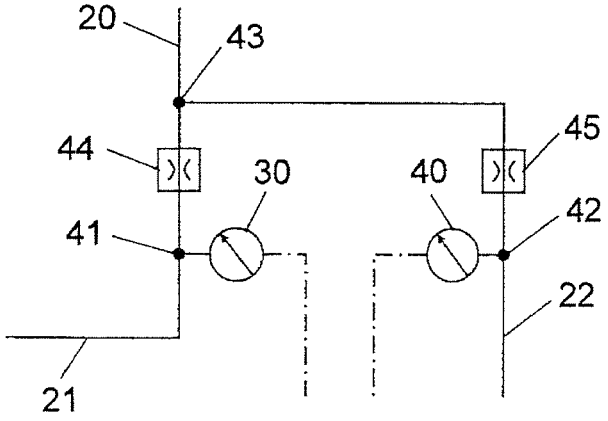
FIG. 7 is a diagram for the supplementary description of operation of the third embodiment.

With reference to FIGS. 6 and 7, a description will next be made about a third embodiment of the present invention. It is to be noted that a description on parts common to the first embodiment is omitted and a description will be made solely of the part of a regeneration ratio control means different from the first embodiment.

The regeneration ratio control means in this third embodiment is constructed, as illustrated in FIG. 6, of the pressure meter 30 and a pressure meter 40 arranged in the flow rate control line 21 and power regeneration line 22, the pressure meter 31 arranged in the pilot line 35 in which the pressure rises upon performing the operation to retract the actuator 14 (upon operation of the pilot valve 16 to the side A), the controller 25, and the electronically-controlled regulator 26. The pressure meters 30,40,31 serve to detect respective pressures of the flow rate control line 21, power regeneration line 22 and pilot line 35 as electric signals, and outputs of the pressure meters 30,31,40 are fed to the controller 25 and are converted to flow rate control line pressure P1, power regeneration line pressure P2 and pilot pressure Pp, respectively.

When the pilot pressure Pp is lower than δ (Pp<δ), the controller 25 outputs, to the variable displacement motor 23, a command that minimizes the displacement of the variable displacement motor 23. δ is set at several percent or so of a maximum value of the pilot pressure Pp, and is a threshold value for preventing outputting an unnecessary control command to the variable displacement motor 23 by a slight variation in the pilot pressure Pp itself or an electric noise produced in the pressure meter when the pilot valve 16 has not been operated to the side A, in other words, when the actuator 14 is not retracting. At this time, the selector valve 24 arranged in the power regeneration line 22 is in the position where it cuts off the line under spring force, and no flow rate occurs in the power regeneration line 22. Because sensing parts 41,42 of the pressure meters 30,40 communicate to each other as illustrated in FIG. 7, a pressure P1 at the sensing part 41 of the pressure meter 30 and a pressure P2 at the sensing part 42 of the pressure meter 40 are substantially equal to each other at this time (P1=P2; the differential pressure due to the difference in the height direction is very small and is ignorable).

When the pilot valve 16 is operated to the side A and the pilot pressure Pp rises to or higher than δ (δ≤Pp), the computation of the target displacement for the variable displacement motor 23 is performed at the controller 25. The controller 25 outputs, to the electronically-controlled regulator 26, a command such that P2 is basically rendered substantially equal to P1. Described specifically, the displacement of the variable displacement motor 23 is changed in a decreasing direction when P2<P1−ϵ, the current displacement is maintained when P1−ϵ≤P2≤P1+ϵ, and the displacement of the variable displacement motor 23 is changed in an increasing direction when $P1+\epsilon<P2$. Here, c means a dead band for stabilizing the control, and is set at several percent or so of the maximum pressure of P2. The value of E is determined by postulating a range capable of sufficiently preventing any false operation for measurement errors by an arranged pressure meter.

Here, a description will be made of the control of P1 and P2 such that they become substantially equal to each other and the relation in flow rate between the flow rate control line 21 and the power regeneration line 22. When a flow rate occurs in a line, the pressure on a downstream side drops due to line resistance. The line resistance between a branch point 43 into the flow rate control line 21 and power regeneration line 22 and the sensing part 41 of the pressure meter 30 is hypothetically assumed to be an equivalent restrictor 44, the line resistance between the branch point 43 and the sensing part 42 of the pressure meter 40 is hypothetically assumed to be an equivalent restrictor 45, and their equivalent opening areas (orifice cross-sectional areas) are assumed to be A01 and A02, respectively. Further, the pressure at the branch point 43 is assumed to be Pa, and the flow rates of the flow rate control line 21 and power regeneration line 22 are assumed to be Q1 and Q2, respectively. It is to be noted that the equivalent restrictors 44,45 are not needed to be arranged with a view to applying pressure losses to the hydraulic circuit but are specifically shown in the hydraulic circuit to describe functions of this third embodiment such as pressure losses at hoses and couplers. Introducing the above-mentioned pressures P1, P2, Pa into a general equation for a pressure loss at an orifice restrictor, the flow rates Q1, Q2 can be expressed as follows:

$$Q1=C\cdot A01\sqrt{\{2(Pa-P1)/\rho\}}$$

$$Q2=C\cdot A02\cdot\{2(Pa-P2)/\rho\}$$

C: flow rate coefficient,

ρ: hydraulic oil coefficient

The relation between Q1 and Q2 can then be expressed as follows:

$$Q2=Q1\cdot(A02/A01)\cdot\sqrt{\{(Pa-P2)/(Pa-P1)\}}$$

Here, when P1 and P2 are the same pressure, $$\sqrt{\{(Pa-P2)/(Pa-P1)\}}=1$$

The following relation can hence be derived:

$$Q2=Q1\cdot(A02/A01)$$

It is, therefore, understood that the flow rate ratio of Q2 to Q1 is determined by the ratio in equivalent opening area of the equivalent restrictor 45 to the equivalent restrictor 44. As these equivalent restrictors 44,45 are line resistances and their equivalent opening areas take fixed values, the flow rate ratio of Q2 to Q1 is controlled at a fixed ratio.

The configuration and operation of the third embodiment are summarized as mentioned above. A supplementary description will be made about transitional states in a series of operations upon causing the actuator 14 to retract (upon performing regeneration).

First, in a state that the lever 15 has not been manipulated, the pilot pressure that acts from the pilot valve 16 on the flow rate control valve 19 and also on the selector valve 24 in the power regeneration line 22 is the tank pressure (substantially zero). In this state, the flow rate control valve 21 is in the center position under the forces of the springs arranged at the opposite ends of its spool and the selector valve 24 is in the position where it closes the line under the spring force, so that the flow rates of the flow rate control line 21 and power regeneration line 22 are zero. At this time, the determination of $Pp<\delta$ is made at the controller 25, a command that sets the target displacement for the variable displacement motor 23 at the minimum displacement is sent to the electronically-controlled regulator 26, and the variable displacement motor 23 is set at zero displacement.

When the pilot valve 16 is operated to the side A from the position where the lever 15 has not been manipulated, the spool of the flow rate control valve 19 begins to move leftward shortly after the operation, so that the line, which connects the hydraulic pump 12 and the port A of the actuator 14 together, and the line, which connects the hydraulic oil tank 18 and the port B of the actuator 14 together, begin to open. Further, the pilot pressure also acts on the selector valve 24 in the power regeneration line 22, so that its spring is pressed and the line begins to open, and further, a flow rate begins to gradually occur in the flow rate control line 21. As the occurrence of the flow rate leads to the occurrence of a pressure loss, the pressure drops further as the hydraulic oil goes to the downstream side. Accordingly, the pressure P1 of the flow rate control line 21 becomes smaller compared with the pressure Pa at the branch point 43. As no flow rate has occurred yet in the power regeneration line 22, on the other hand, no pressure loss occurs, and Pa and P2 are equal to each other (Pa=P2). In a state that P2 is in a range of not higher than $P1+\epsilon$ ($P2\leq P1+\epsilon$), the variable displacement motor 23 is still in the controlled state of zero displacement and no flow rate occurs in the power regeneration line 22. When time goes on and at a time point that P2 has become higher than $P1+\epsilon$ ($P1+\epsilon<P2$), the value of the target displacement for the variable displacement motor 23 begins to increase in the controller 25. When time goes on further, the value of the target displacement command from the controller 25 to the electronically-controlled regulator 26 also increases adequately, and a flow rate corresponding to the displacement of the variable displacement motor 23 occurs in the power regeneration line 22. As a result of the occurrence of the flow rate in the power regeneration line 22, P2 becomes smaller than Pa due to a pressure loss. When this state continues, the state of $P1-\epsilon\leq P2\leq P1+\epsilon$ is eventually reached and the displacement of the variable displacement motor 23 at that point is maintained. In this manner, P2 is controlled to become substantially equal to P1, and as mentioned above, the flow rate Q2 of the power regeneration line 22 is adjusted to satisfy the fixed ratio relative to the flow rate Q1 of the flow rate control line 21.

A description will next be made about a case of returning the lever 16 from the state that the pilot valve 16 has been operated to the side A and the flow rate Q2 of the power regeneration line 22 has been adjusted to satisfy the fixed ratio relative to Q1. When it begins to return the lever 16, the spool of the flow rate control valve 19 begins to move rightward, and the line, which connects the hydraulic pump 12 and the port A of the actuator 14 together, and the line, which connects the hydraulic oil tank 18 and the port B of the actuator 14 together, begin to close. At this time, the flow rate Q1 of the flow rate control line 21 begins to decrease gradually. As this decrease in the flow rate Q1 reduces the pressure loss at the equivalent restrictor 44, the pressure P1 increases. When time goes on and the state of $P2<P1-\epsilon$ is reached, the value of the target displacement for the variable displacement motor 23 begins to decrease in the controller 25. The displacement of the variable displacement motor 23 then decreases correspondingly, and the flow rate Q2 of the power regeneration line 22 decreases. As this decrease in the flow rate Q2 reduces the pressure loss at the equivalent restrictor 45, the pressure P2 increases. In this manner, the control is performed such that P2 catches up P1, and Q1 and Q2 are readjusted to satisfy the fixed ratio. Incidentally, the flow rate Q2 progressively decreases with the fixed ratio being maintained when the manipulation to return the lever 15 is slowly conducted, but a situation arises that the readjustment of a decrease in the flow rate of the power regeneration line 22 does not catch up a decrease in the flow rate of the flow rate control line 21 when the lever 15 is quickly returned. When the lever 15 is returned to the neutral (unmanipulated) state in such a situation, the selector valve 24 in the power regeneration line 22 also moves to a position where it closes the line, so that the flow of hydraulic oil through the power regeneration line 22 is forcedly cut off. As the variable displacement motor 23 has at this moment a certain displacement which is not zero, the variable displacement motor 23 sucks up hydraulic oil from the make-up line 29, thereby avoiding cavitation which would otherwise occur due to an insufficient feed flow rate to the suction port, reducing an increase in absorbed torque (power loss) as a result of pumping action of the variable displacement motor 23, and also minimizing damage to the variable displacement motor 23. Since the pilot pressure Pp drops to zero as a result of the return of the lever 15 to the neutral position, $Pp<\delta$ is determined at the controller 25, a command that sets the target displacement for the variable displacement motor 23 at the minimum displacement is delivered to the electronically-controlled regulator 26, and the displacement of the variable displacement motor 23 finally returns to zero. Because a quick lever-returning manipulation can quickly stop the actuator 14 irrespective of the displacement condition of the variable displacement motor 23 as described above, it is possible to avoid a danger which would otherwise arise due to a delay in the stoppage of the actuator 14 in the event of an emergency.

Figure 8:
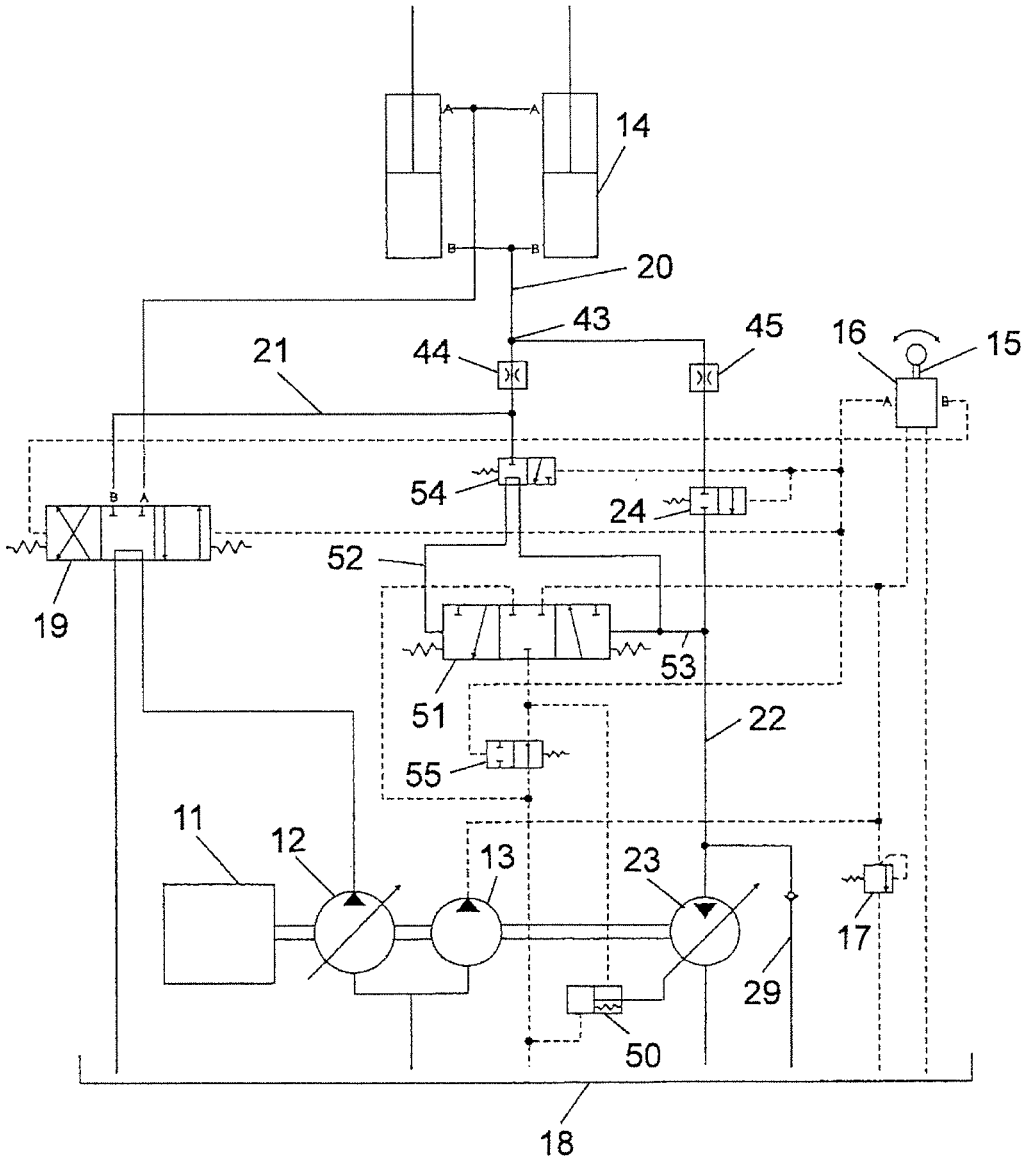
FIG. 8 is a hydraulic circuit diagram illustrating a fourth embodiment of the present invention.

With reference to FIG. 8, a description will next be made about a fourth embodiment of the present invention. It is to be noted that a description on parts common to the first embodiment is omitted and a description will be made solely of the part of a regeneration ratio control means different from the first embodiment.

The regeneration ratio control means in this fourth embodiment is constructed, as illustrated in FIG. 8, of a motor displacement control cylinder 50 for controlling the displacement of the variable displacement motor 23, a motor displacement control spool 51 for controlling the supply of hydraulic oil to the motor displacement control cylinder 50, a first pressure detection line 52 branching from the flow rate control line 21 and extending to the motor displacement control spool 51, a second pressure detection line 53 branching from the power regeneration line 22 and extending to the motor displacement control spool 51, a selector valve 54 arranged in the first pressure detection line 52, and a selector valve 55 arranged in a line that connects the motor displacement control spool 51 and the motor displacement control cylinder 50 together.

The motor displacement control cylinder 50 is a 2-port single-acting cylinder, and strokes in a direction to decrease the displacement of the motor when a pilot pressure acts on one of its ports, i.e., a pilot port. It is also constructed to return to zero displacement by a built-in spring when no pilot pressure is acting. The other port, i.e., a tank port is always connected to the hydraulic oil tank 18. Because of its mechanism, the variable displacement motor 23 has a characteristic that, when a flow rate occurs in its inlet port, it tends to automatically change in a direction to lower the pressure of the flow rate, specifically to increase its displacement. The motor displacement control cylinder 50 is, therefore, constructed to produce thrust in a direction to decrease the displacement of the motor against the automated displacement adjusting function of the motor. When the lever 15 has not been manipulated (is in the neutral position), the selector valve 55 is in a position where it communicates the pilot port to the hydraulic oil tank 18, and therefore, the displacement of the variable displacement motor 23 is set at zero.

To the pilot port of the motor displacement control cylinder 50, the motor displacement control spool 51 is connected, and to the motor displacement control spool 51, the pilot pump 13 is connected. Further, the first pressure detection line 52 and second pressure detection line 53 are connected to opposite ends of the motor displacement control spool 51, respectively, so that the spool moves according to a differential pressure between both the pressure detection lines 52 and 53. When a pressure P1 of the first pressure detection line 52 is high, the spool moves rightward, the pilot pump 13 is connected to the pilot port of the motor displacement control cylinder 50, and the displacement of the motor decreases. When a pressure P2 of the second pressure detection line 53 is high, the spool moves leftward, the pilot port of the motor displacement control cylinder 50 is connected to the hydraulic oil tank 18, no thrust is produced by the motor displacement control cylinder 50, and the displacement of the motor increases by the automated displacement adjusting function of the motor. In this embodiment, springs are arranged at the opposite ends of the motor displacement control spool 51, respectively, such that the motor displacement control spool 51 assumes a center position when P1 and P2 are the same pressure. Further, when the lever 15 has not been manipulated (is in the neutral position), the selector valve 54 is in a position where it connects the first pressure detection line 52 and the second pressure detection line 53 together, P1 and P2 become the same pressure, and therefore, the motor displacement control spool 51 assumes the center position.

When the actuator 14 is caused to retract by manipulating the lever 15, the spool of the flow rate control valve 19 moves leftward, and at the same time, the selector valve 55 is switched to the closed position, the selector valve 24 is switched to the open position, and the selector valve 54 is switched to a position where it communicates the first pressure detection line 52 and the spool line to each other. Then, the hydraulic oil discharged from the actuator 14 passes through the flow rate control line 21 and returns from the spool of the flow rate control valve 19 to the hydraulic oil tank 18, and a pressure loss occurs at the equivalent restrictor 44. Shortly after the initiation of the lever manipulation, the hydraulic oil also begins to flow into the power regeneration line 22. However, the variable displacement motor 23 is at the zero displacement position and no flow rate has occurred, and therefore, no pressure loss has occurred at the equivalent restrictor 45. Therefore, the motor displacement control spool 51 moves leftward, and the pilot port of the motor displacement control cylinder 50 is communicated to the hydraulic oil tank 18. At the same time, under the pressure occurred in the power regeneration line 22, the displacement of the variable displacement motor 23 automatically beings to increase so that a flow rate occurs in the power regeneration line 22. When the flow rate occurs in the power regeneration line 22, a pressure loss occurs at the equivalent restrictor 45, and the pressure P2 detected at the second pressure detection line 53 begins to drop. When the flow rate of the power regeneration line 22 increases and P2 drops to a predetermined pressure or lower relative to the pressure P1 of the first pressure detection line 52, the motor displacement control spool 51 moves rightward, and the pilot pressure acts on the pilot port of the motor displacement control cylinder 50 to decrease the displacement of the motor. In this manner, the displacement of the variable displacement motor 23 is automatically adjusted such that P2 becomes the same pressure as P1. It is to be noted that as described in connection with the third embodiment, to control such that P2 becomes the same pressure as P1 is the same as to control the flow rate ratio of Q2 to Q1 at a fixed ratio.

Figure 9:
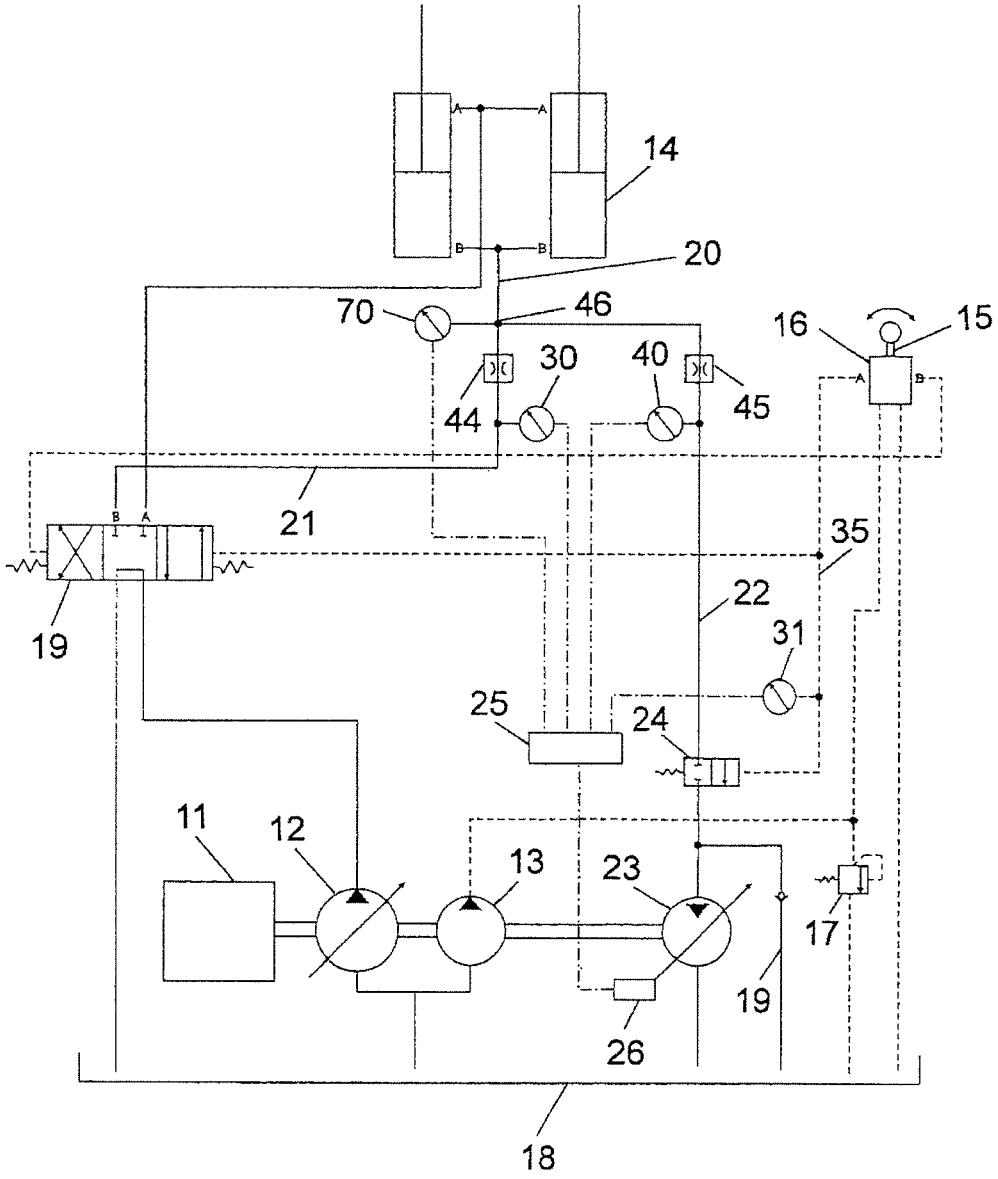
FIG. 9 is a hydraulic circuit diagram illustrating a fifth embodiment of the present invention.

With reference to FIG. 9, a description will next be made about a fifth embodiment of the present invention. This fifth embodiment is provided, in addition to the construction of the third embodiment, with a pressure meter 70 for detecting a pressure at a branch point 46 from the hydraulic oil drain line 20 into the power regeneration line 22. By configuring as described above, the flow rate ratio of the power regeneration line 22 to the flow rate control line 21 can be set at a desired ratio without relying upon the equivalent restrictor 44 and equivalent restrictor 45. A description will hereinafter be made of a method for setting their flow rate ratio at a desired flow rate ratio.

A target flow rate Q2 for the power regeneration line 22 relative to the flow rate Q1 of the flow rate control line 21 can be expressed as follows:

$$Q2=\alpha\cdot Q1 \quad (\alpha\text{: preset flow rate ratio})$$

Further, the relation with the respective pressures can be expressed as follows:

$$Q2=Q1\cdot(A02/A01)\cdot\sqrt{\{(Pa-P2)/(Pa-P1)\}}$$

so that the following equation can be derived:

$$\alpha=(A02/A01)\cdot\sqrt{\{(Pa-P2)/(Pa-P1)\}}$$

This equation can be modified into the following equation:

$$P2=Pa-(\alpha^2\cdot A01^2/A02^2)\cdot(Pa-P1) \qquad \text{Equation (3)}$$

Therefore, for controlling to bring the flow rate ratio to $\alpha$, it is only necessary to set a control target value Pt2 for the pressure P2 as defined by Equation (3). The controller 25 outputs, to the electronically-controlled regulator 26, a command such that P2 is basically rendered substantially equal to Pt2. Described specifically, the displacement of the variable displacement motor 23 is changed in a decreasing direction when $P2<Pt2-\epsilon$, the current displacement is maintained when $Pt2-\epsilon\leq P2\leq Pt2+\epsilon$, and the displacement of the variable displacement motor 23 is changed in an increasing direction when $Pt2+\epsilon<P2$. Here, $\epsilon$ means a dead band for stabilizing the control, and is set at several percent or so of the maximum pressure of P2. The value of $\epsilon$ is determined by postulating a range capable of sufficiently preventing any false operation for measurement errors by a used pressure meter.

Figure 10:
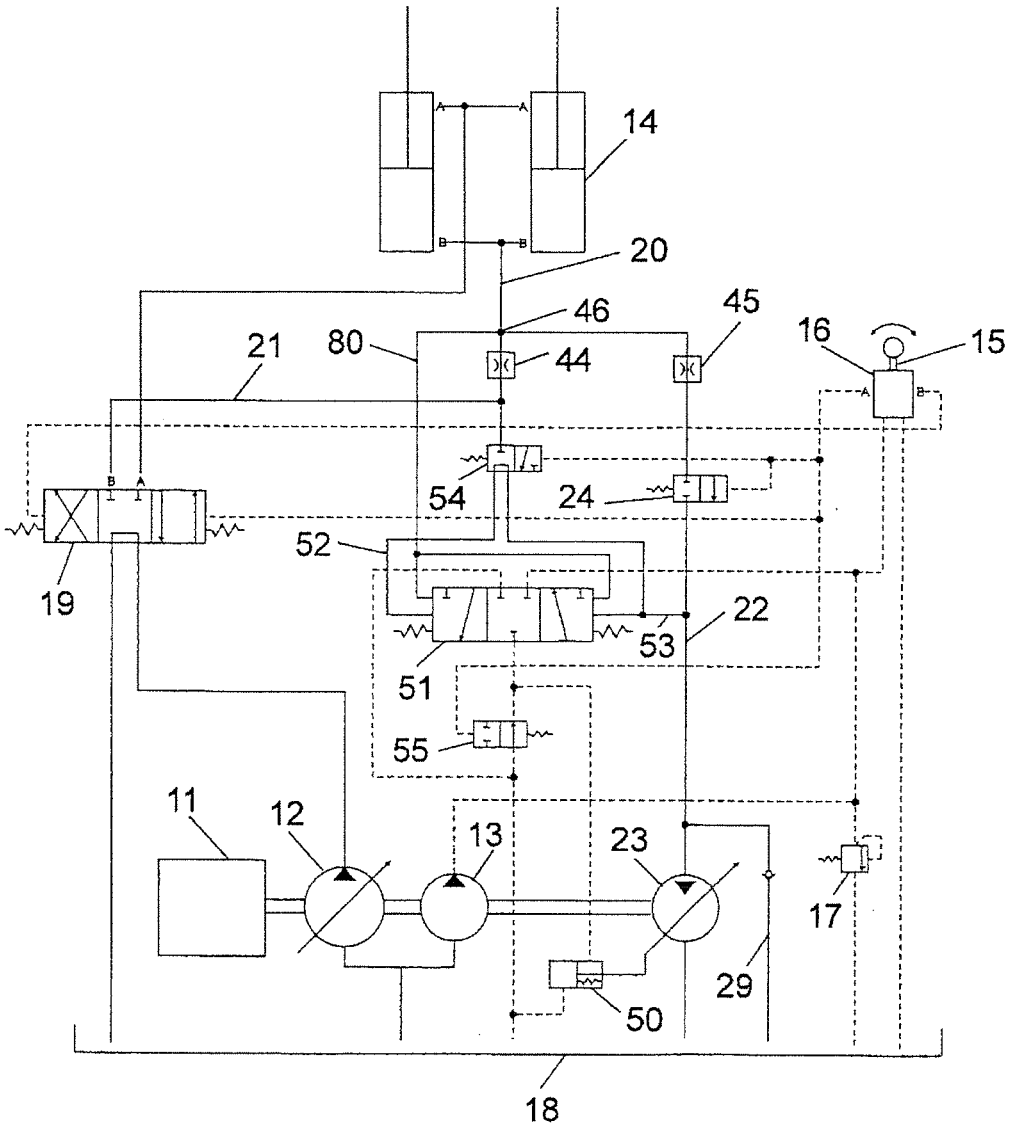
FIG. 10 is a hydraulic circuit diagram illustrating a sixth embodiment of the present invention.

With reference to FIG. 10, a description will next be made about a sixth embodiment of the present invention. This embodiment is provided, in addition to the construction of the fourth embodiment, with a third pressure detection line 80 for detecting a pressure at the branch point 46 from the hydraulic oil drain line 20 into the power regeneration line 22, and this third pressure detection line 80 is connected to the opposite ends of the motor displacement control spool 51, respectively. The motor displacement control spool 51 is provided at the opposite ends thereof with two pairs of pressure-receiving parts, respectively, the pressure-receiving parts in one of the two pairs having a pressure-receiving area AP1 and those in the other pair having a pressure receiving area AP2. In the diagram, the third pressure detection line 80 is connected to the pressure-receiving parts having the pressure-receiving area AP1 on a left side of the motor displacement control spool 51 and the pressure-receiving parts having the pressure-receiving area AP2 on a right side of the motor displacement control spool 51, the first pressure detection line 52 is connected to the pressure-receiving parts having the pressure-receiving area AP2 on the left side of the motor displacement control spool 51, and the second pressure detection line 53 is connected to the pressure-receiving parts having the pressure-receiving area AP1 on the right side of the motor displacement control spool 51.

The motor displacement control spool 51 in this sixth embodiment is provided at the opposite ends of its spool with springs, respectively, such that the motor displacement control spool 51 assumes the center position when Pa, P1 and P2 are all zero. Assuming that their spring coefficient (the total value of the springs at the opposite ends of the spool) is k, a spring stroke S can be expressed by the following equation:

$$S=\{AP1(Pa-P1)-AP2(Pa-P2)\}/k$$

Therefore, conditions for setting the spool stroke at zero (center position) are:

$$AP1(Pa-P1)-AP2(Pa-P2)=0$$

Modifying this equation, the following equation can be derived:

$$(Pa-P2)/(Pa-P1)=AP1/AP2$$

Further, the relation between Q1 and Q2 can be expressed as follows:

$$Q2=Q1\cdot(A02/A01)\cdot\sqrt{\{(Pa-P2)/(Pa-P1)\}}$$

so that the following equation can be derived:

$$Q2=Q1\cdot(A02/A01)\cdot\sqrt{(AP1/AP2)}$$

As understood from the foregoing, the flow rate ratio of Q2 to Q1 is determined by the equivalent opening area ratio of the equivalent restrictor 45 to the equivalent restrictor 44 and the pressure-receiving area ratio of the pressure-receiving parts at the opposite ends of the motor displacement control spool 51. In other words, this means that the flow rate ratio of Q2 to Q1 is not limited to the equivalent opening area ratio of the equivalent restrictor 45 to the equivalent restrictor 44 but can be set as desired by the pressure-receiving area ratio of the pressure-receiving parts at the opposite ends of the motor displacement control spool 51.

In each of the above-mentioned embodiments, the variable displacement motor 23 is mechanically connected to the rotary power producing means 11 via the hydraulic pump 12. However, the present invention is not limited to such a configuration but may be configured, for example, with the variable displacement motor 23 being connected to a generator or the like arranged in addition to the rotary power producing means 11.

LEGEND

1 Travel base
2 Upperstructure
3 Working equipment
4 Boom
4*a* Boom cylinder
11 Rotary power producing means
12 Hydraulic pump
13 Pilot pump
14 Actuator

15 Lever
16 Pilot valve
17 Pilot relief valve
18 Hydraulic oil tank
19 Flow rate control valve
20 Hydraulic oil drain line
21 Flow rate control line
22 Power regeneration line
23 Variable displacement motor (power regeneration means)
24 Selector valve
25 Controller
26 Electronically-controlled regulator
27 Flowmeter
28 Flowmeter
29 Make-up line
30 Pressure meter
31 Pressure meter
35 Pilot line
40 Pressure meter
41 Sensing part
43 Branch point
44 Equivalent restrictor
45 Equivalent restrictor
46 Branch point
50 Motor displacement control cylinder
51 Motor displacement control spool
52 First pressure detection line
53 Second pressure detection line
54 Selector valve
55 Selector valve
70 Pressure meter
80 Third pressure detection line

The invention claimed is:

1. A hydraulic system for a hydraulic working machine, comprising:

a hydraulic oil drain line;

an actuator, wherein the hydraulic oil drain line is branched into a flow rate control line as a line connected to a flow rate control spool controllable by manipulation of a lever and a power regeneration line as a line connected to a power regeneration means for converting hydraulic power of discharged hydraulic oil to reusable energy; and a regeneration ratio control means for controlling the power regeneration means such that, a flow rate that occurs in the flow rate control line upon manipulation of the lever due to the flow rate control spool that has been controlled by manipulation of the lever and a flow rate of the power regeneration line satisfy a preset fixed ratio, wherein the hydraulic system is capable of inputting rotary power from a rotary power producing means to a hydraulic pump to produce the hydraulic power and operating the actuator by the hydraulic power, the power regeneration means is a variable displacement motor, and the regeneration ratio control means comprises a first pressure detection unit arranged in the flow rate control line, a second pressure detection unit arranged in the power regeneration line, and a motor displacement control means for decreasing a displacement of the variable displacement motor when a pressure of the first pressure detection unit is higher than a pressure of the second pressure detection unit, increasing the displacement of the variable displacement motor when the pressure of the first pressure detection unit is lower than the pressure of the second pressure detection unit, or fixing the displacement of the variable displacement motor when the pressure of the first pressure detection unit and the pressure of the second pressure detection unit are the same.

2. The hydraulic system according to claim 1, wherein: the power regeneration means is mechanically connected to the hydraulic pump.

* * * * *